US010874154B2

(12) United States Patent
Aitch

(10) Patent No.: US 10,874,154 B2
(45) Date of Patent: Dec. 29, 2020

(54) JACKET WITH EXPANDABLE SCALLOPED SHOULDER REGIONS

(71) Applicant: Lauren Aitch, Lansing, MI (US)

(72) Inventor: Lauren Aitch, Lansing, MI (US)

( * ) Notice: Subject to any disclaimer, the term of this patent is extended or adjusted under 35 U.S.C. 154(b) by 164 days.

(21) Appl. No.: 15/927,580

(22) Filed: Mar. 21, 2018

(65) Prior Publication Data

US 2018/0271193 A1 Sep. 27, 2018

Related U.S. Application Data

(60) Provisional application No. 62/477,367, filed on Mar. 27, 2017.

(51) Int. Cl.

| | |
|---|---|
| ***A41D 27/28*** | (2006.01) |
| ***A41D 27/10*** | (2006.01) |
| ***A41D 27/26*** | (2006.01) |
| ***A41D 1/04*** | (2006.01) |
| ***A41D 31/06*** | (2019.01) |
| ***A41D 31/14*** | (2019.01) |
| ***A41D 13/00*** | (2006.01) |
| *A41D 27/20* | (2006.01) |

(52) U.S. Cl.

CPC ..... *A41D 27/285* (2013.01); *A41D 1/04* (2013.01); *A41D 13/0015* (2013.01); *A41D 27/10* (2013.01); *A41D 31/065* (2019.02); *A41D 31/14* (2019.02); *A41D 27/205* (2013.01); *A41D 27/26* (2013.01); *A41D 2300/22* (2013.01); *A41D 2400/10* (2013.01); *A41D 2600/10* (2013.01)

(58) Field of Classification Search

CPC .... A41D 27/285; A41D 31/14; A41D 31/065; A41D 1/04; A41D 13/0015; A41D 27/205; A41D 27/26; A41D 2300/22; A41D 2400/10; A41D 2600/10; A41D 27/10; A41D 3/00; A41D 3/02; A41D 31/02; A41B 1/00; A41B 1/08; A63B 71/12

USPC ..... 2/85, 87, 93, 115, 122, 268–270, 461, 2/462, DIG. 1

See application file for complete search history.

(56) References Cited

U.S. PATENT DOCUMENTS 1,177,952 A * 4/1916 Inman ..... A41D 1/02 2/93
1,562,767 A * 11/1925 Hess ..... A41D 27/28 2/87

(Continued)

FOREIGN PATENT DOCUMENTS

| | | | | |
|---|---|---|---|---|
| CA | 1099452 A * | 4/1981 | ..... | A41D 27/10 |
| EP | 1216728 A2 | 6/2002 | | |
| GB | 381126 A * | 9/1932 | ..... | A41B 3/00 |

*Primary Examiner* — Jameson D Collier

(74) *Attorney, Agent, or Firm* — McDonnell Boehnen Hulbert & Berghoff LLP

(57) ABSTRACT

A garment is disclosed that includes (a) a back panel, (b) a front panel including an openable seam, wherein the back panel and the front panel are coupled together and define a neck opening, a first arm opening, a second arm opening and a torso opening, (c) a first sleeve having a first end and a second end, the first end of the first sleeve coupled to the first arm opening, the first end of the first sleeve having a first plurality of elastic panels each covered by a scallop-shaped panel, and (d) a second sleeve having a first end and a second end, the first end of the second sleeve coupled to the second arm opening, the first end of the second sleeve having a second plurality of elastic panels each covered by a scallop-shaped panel.

19 Claims, 11 Drawing Sheets

(56) References Cited

U.S. PATENT DOCUMENTS 1,987,954 A * 1/1935 Halpern ..... A41D 1/04 2/108
2,150,251 A * 3/1939 Shanhouse ..... A41D 13/0012 2/94
2,259,560 A * 10/1941 Glidden ..... A41D 27/28 428/134
2,755,480 A * 7/1956 Jones ..... A41D 13/0012 2/94
3,921,221 A * 11/1975 Zoephel ..... A41D 13/1209 2/51
4,320,538 A * 3/1982 Saft ..... A41D 15/007 2/102
5,101,514 A * 4/1992 Eklund ..... A41D 13/0537 2/87
5,168,580 A * 12/1992 Foo ..... A41D 15/00 2/115
5,416,928 A * 5/1995 Koenig ..... A41D 27/08 2/105
6,029,270 A * 2/2000 Ost ..... A41D 3/00 2/2.5
6,564,387 B1 * 5/2003 Willoughby ..... A41D 13/0537 2/69
6,681,399 B1 * 1/2004 Kerr ..... A41D 13/0125 2/2.5
7,028,342 B1 4/2006 Nordstrom et al.
7,636,950 B2 12/2009 Melhart et al.
7,669,250 B2 3/2010 Baron et al.
8,336,117 B2 12/2012 Carter et al.
8,402,562 B1 * 3/2013 Seddiki ..... A41D 27/205 2/247
8,585,746 B2 11/2013 Ilcheva et al.
8,677,512 B2 3/2014 Nordstrom et al.
9,392,825 B2 7/2016 Pezzimenti et al.
D836,887 S * 1/2019 Aitch ..... D2/828
2005/0223465 A1 10/2005 Williams et al.
2006/0080755 A1 4/2006 Baron et al.
2008/0244812 A1 * 10/2008 Phaneuf ..... A63B 71/12 2/462
2008/0289078 A1 11/2008 Mather
2010/0024089 A1 2/2010 Turner
2012/0060260 A1 * 3/2012 Kochling ..... A41D 27/205 2/250
2013/0061366 A1 3/2013 Pezzimenti
2013/0205467 A1 * 8/2013 Walrich ..... A41D 27/10 2/93
2014/0020149 A1 * 1/2014 Yamada ..... A41D 13/0015 2/69
2014/0130232 A1 5/2014 Farron et al.
2014/0201883 A1 7/2014 Achtymichuk
2014/0338091 A1 11/2014 Kenney et al.
2014/0373243 A1 * 12/2014 Bergeron ..... F41H 1/00 2/2.5
2015/0082506 A1 * 3/2015 Yee ..... A41D 27/204 2/69
2015/0374049 A1 * 12/2015 Lake ..... A41D 15/00 2/458
2016/0255888 A1 * 9/2016 Morag ..... A41D 27/10
2016/0339664 A1 * 11/2016 Gallagher ..... B32B 7/14
2019/0150539 A1 * 5/2019 Hiney ..... A41D 27/10

* cited by examiner

JACKET WITH EXPANDABLE SCALLOPED SHOULDER REGIONS

CROSS-REFERENCE TO RELATED APPLICATIONS

This application claims priority to U.S. Provisional Patent Application No. 62/477,367, filed Mar. 27, 2017, the contents of which are hereby incorporated by reference in their entirety.

BACKGROUND

Unless otherwise indicated herein, the materials described in this section are not prior art to the claims in this application and are not admitted to be prior art by inclusion in this section.

Athletic competition and training often requires an individual to engage in strenuous activity outdoors during inclement weather. With the desire to stay active year round, there is a need for insulating garments for use during physical activity in the cold weather months. In particular, many athletes (for example, football players) have a need to keep their elbow, shoulder, shoulder blade and pectoral muscles, joints and tendons warm and ready for action when they are on the sidelines waiting to enter the field of play. Traditional cold weather garments for football players are bulky, uncomfortable, and difficult to remove when it is time to take the field. Therefore, an improved cold weather garment may be desirable.

SUMMARY

Thus, in one aspect, a garment is provided, comprising: (a) a back panel, (b) a front panel including an openable seam, wherein the back panel and the front panel are coupled together and define a neck opening, a first arm opening, a second arm opening and a torso opening, (c) a first sleeve having a first end and a second end, the first end of the first sleeve coupled to the first arm opening, the first end of the first sleeve having a first plurality of elastic panels each covered by a scallop-shaped panel, and (d) a second sleeve having a first end and a second end, the first end of the second sleeve coupled to the second arm opening, the first end of the second sleeve having a second plurality of elastic panels each covered by a scallop-shaped panel.

These as well as other aspects, advantages, and alternatives, will become apparent to those of ordinary skill in the art by reading the following detailed description, with reference where appropriate to the accompanying drawings.

DETAILED DESCRIPTION

Example methods and systems are described herein. It should be understood that the words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

As used herein, with respect to measurements, "about" means +/−5%.

Figure 1:
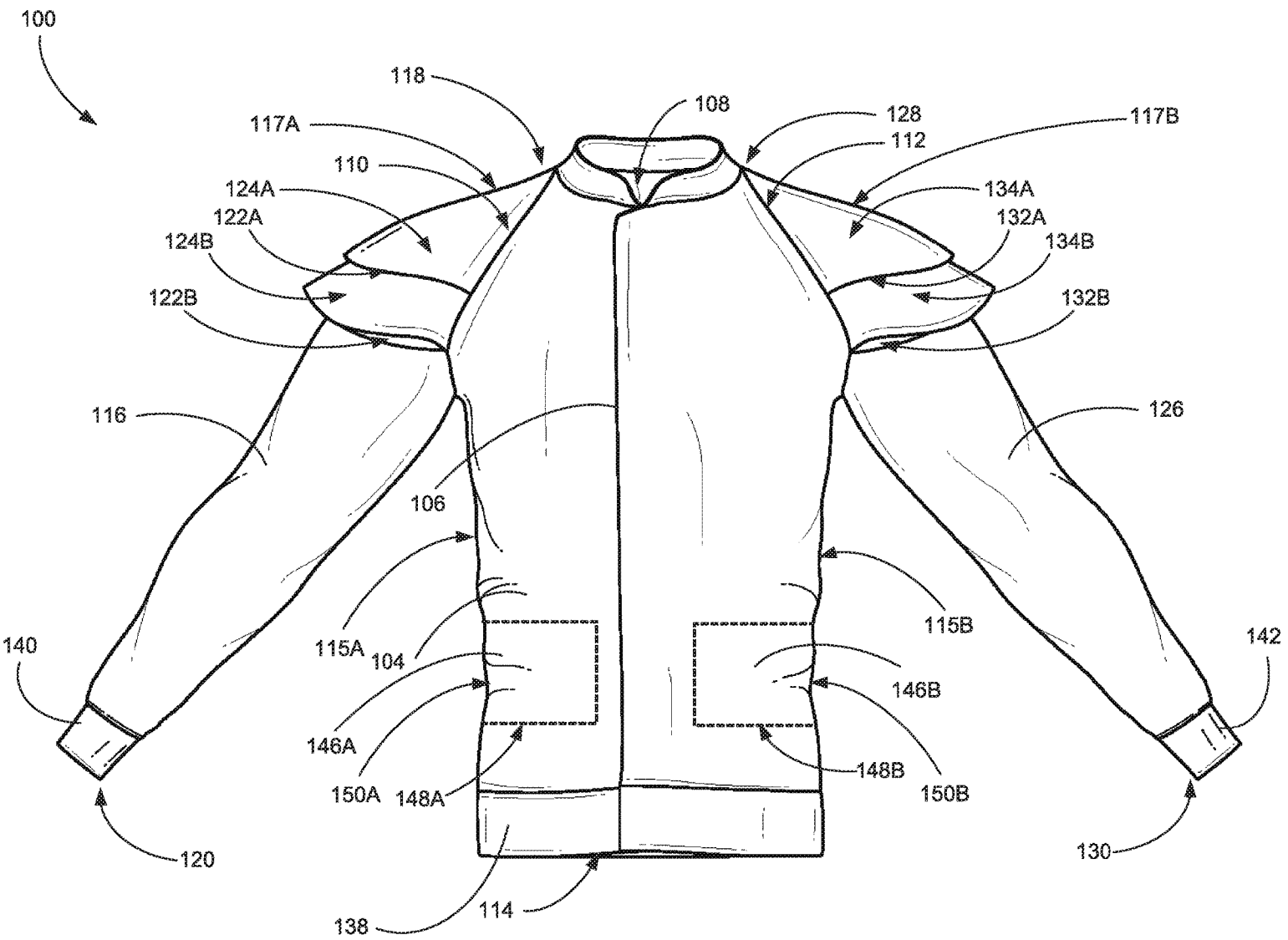
FIG. 1 illustrates a front view of a garment, according to an example embodiment.
Figure 2:
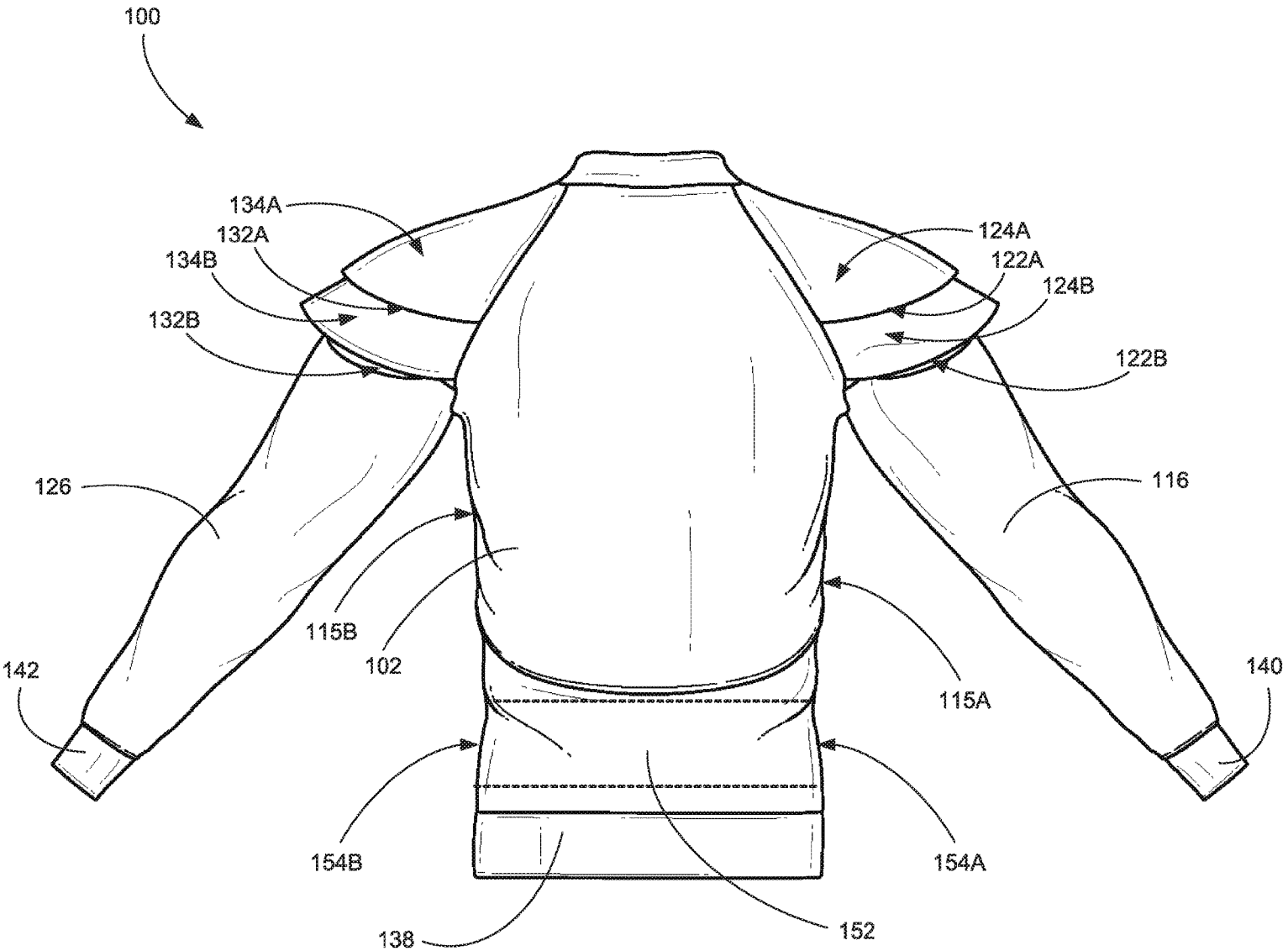
FIG. 2 illustrates a rear view of the garment of FIG. 1, according to an example embodiment.

With reference to the Figures, FIG. 1 illustrates a front view of an example garment 100. The garment 100 may include a back panel 102, as shown in FIG. 2. The garment 100 may also include a front panel 104 including an openable seam 106. The back panel 102 and the front panel 104 are coupled together along side seams and define a neck opening 108, a first arm opening 110, a second arm opening 112, and a torso opening 114. In one example, the front panel 104 and back panel 102 may be provided as a single panel and joined together along side seams 115A, 115B. In another example, the front panel 104 and back panel 102 may be provided as a single panel and joined together along shoulder seams 117A, 117B. In an alternative embodiment, the front panel 104 and back panel 102 may be provided as separate panels and joined together along both side seams 115A, 115B and shoulder seams 117A, 117B. In various other embodiments, multiple panels may be joined together to effectively achieve a front panel 104 and a back panel 102.

Figure 3A:
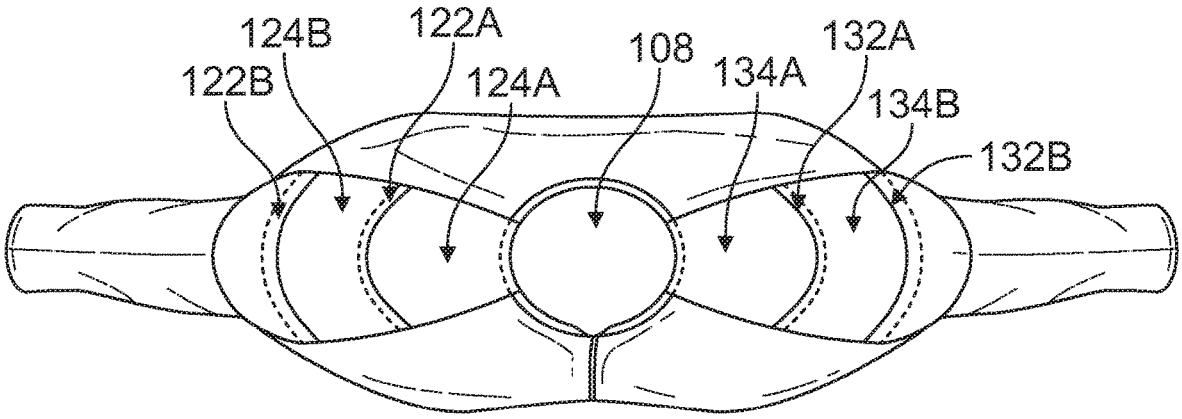
FIG. 3A illustrates a top view of the garment of FIG. 1 including the elastic panels in an expanded condition, according to an example embodiment.
Figure 3B:
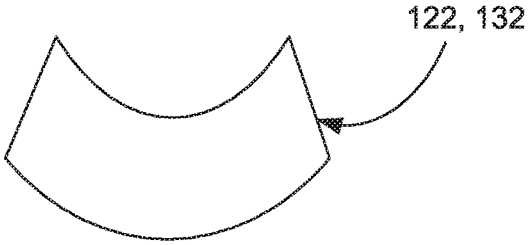
FIG. 3B illustrates an example elastic panel, according to an example embodiment.
Figure 4:
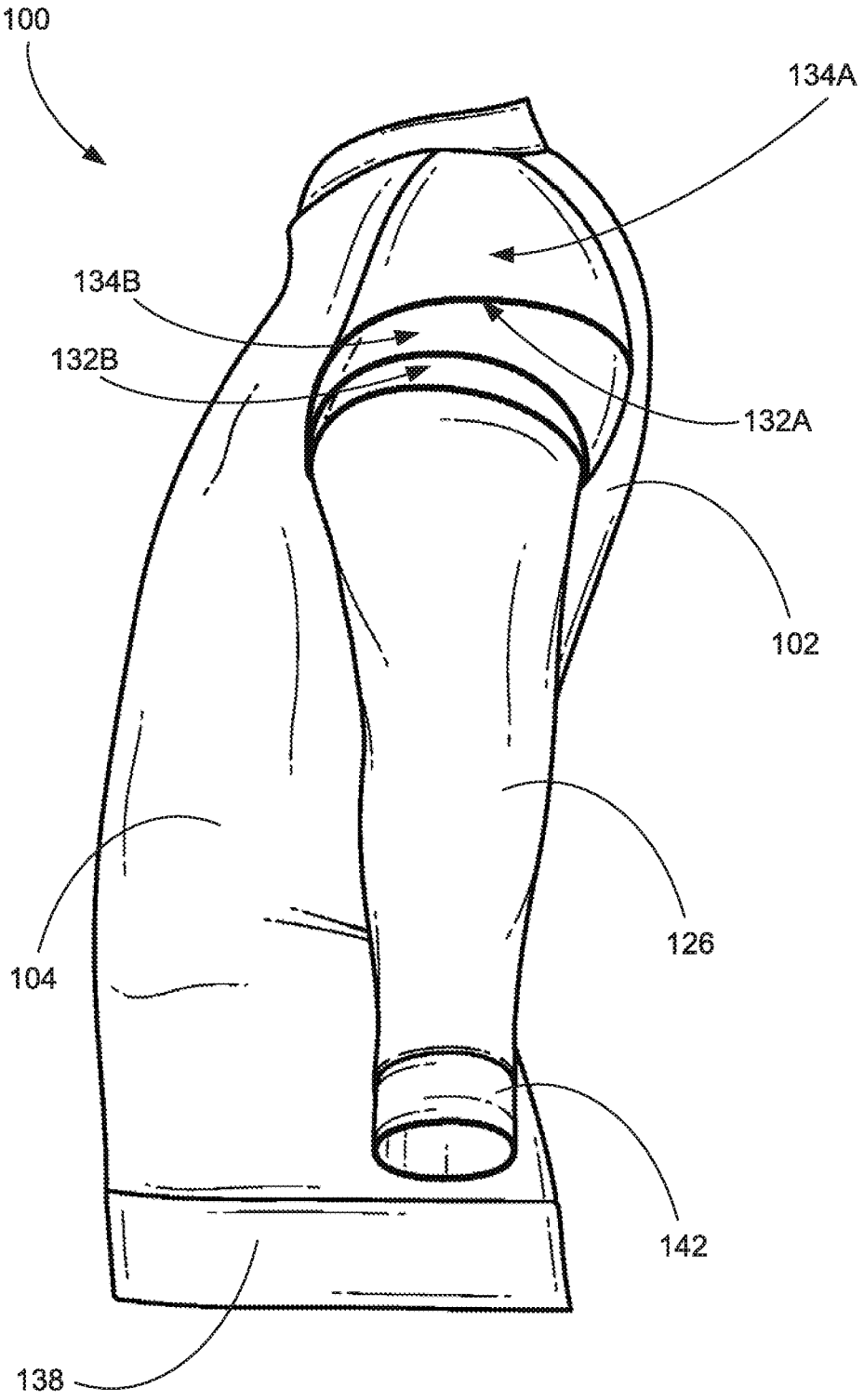
FIG. 4 illustrates a left side view of the garment of FIG. 1, according to an example embodiment.

The garment 100 further includes a first sleeve 116 having a first end 118 and a second end 120. The first end 118 of the first sleeve 116 is coupled to the first arm opening 110. In addition, the first end 118 of the first sleeve 116 has a first plurality of elastic panels 122 each covered by a scallop-shaped panel 124. Similarly, the garment 100 also includes a second sleeve 126 having a first end 128 and a second end 130. The first end 128 of the second sleeve 126 is coupled to the second arm opening 112. In addition, the first end 128 of the second sleeve 126 has a second plurality of elastic panels 132 each covered by a scallop-shaped panel 134. In some examples, the first and second plurality of elastic panels 122, 132 have a conical or frusto-conical profile, as shown in FIG. 3B. In various examples, the first and second plurality of elastic panels 122, 132 may be a breathable mesh material or an elastic material, such as a 4-way stretch material, for example. As shown in FIG. 3A, the first and second plurality of elastic panels 122, 132 are configured to expand over the shoulder pads of a user. For example, a user may be wearing protective shoulder pads such as those used in football, hockey and lacrosse, for example, that are not easily accommodated by garments known in the art. The garment 100 advantageously provides a form-fitting profile for a user wearing shoulder pads to increase retention of body heat. The garment 100 may also increase the speed with which the garment 100 may be taken on and off by a user moving between the sidelines and the field of play, for example. Still further, the garment 100 may beneficially decrease the need for a user to wear a base layer to stay warm. In addition, the garment 100 may be used during out door practices and/or warm-ups. As such, the garment 100 can be used in situations before game time and leading up to game time and not just on the sidelines as in the existing designs. The various components described above may be coupled to one another to thereby create the garment 100. In some examples, interior seams may be sewn with a flat-lock stitch application.

In one particular example, as shown in FIG. 1, the first plurality of elastic panels 122 comprises a first elastic panel 122A covered by a first scallop-shaped panel 124A and a second elastic panel 122B covered by a second scallop-shaped panel 124B. A free end of the first scallop-shaped panel 124A at least partially overlaps the second scallop-shaped panel 124B. The first elastic panel 122A is positioned between the first scallop-shaped panel 124A and the second scallop-shaped panel 124B, and the second elastic panel 122B is positioned between the second scallop-shaped panel 124B and the second end 120 of the first sleeve 116. The second plurality of elastic panels 132 comprises a third elastic panel 132A covered by a third scallop-shaped panel 134A and a fourth elastic panel 132B covered by a fourth scallop-shaped panel 134B. A free end of the third scallop-shaped panel 134A at least partially overlaps the fourth scallop-shaped panel 134B. The third elastic panel 132A is positioned between the third scallop-shaped panel 134A and the fourth scallop-shaped panel 134B, and the fourth elastic panel 132B is positioned between the fourth scallop-shaped panel 134B and the second end 130 of the second sleeve 126.

Figure 7:
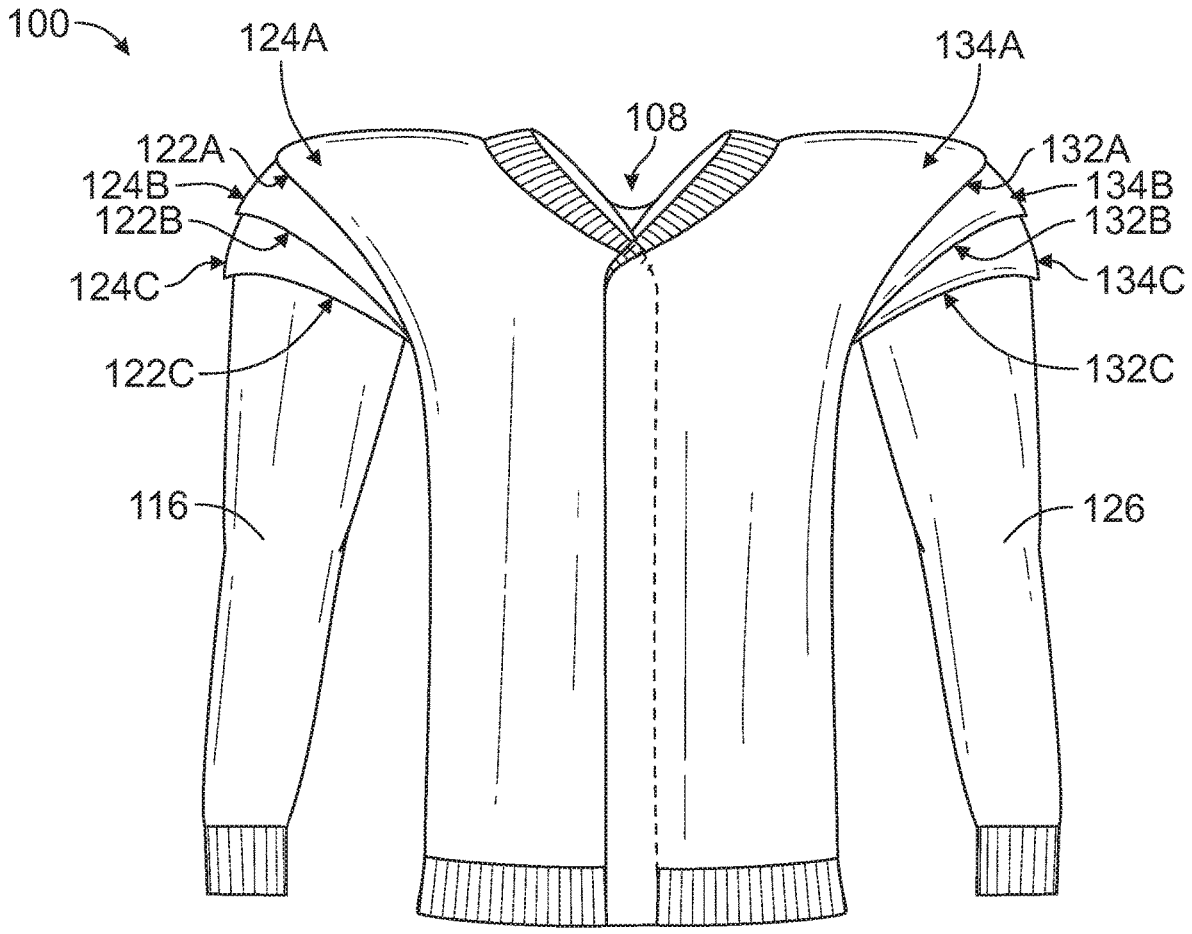
FIG. 7 illustrates a front view of another example garment, according to an example embodiment.
Figure 8:
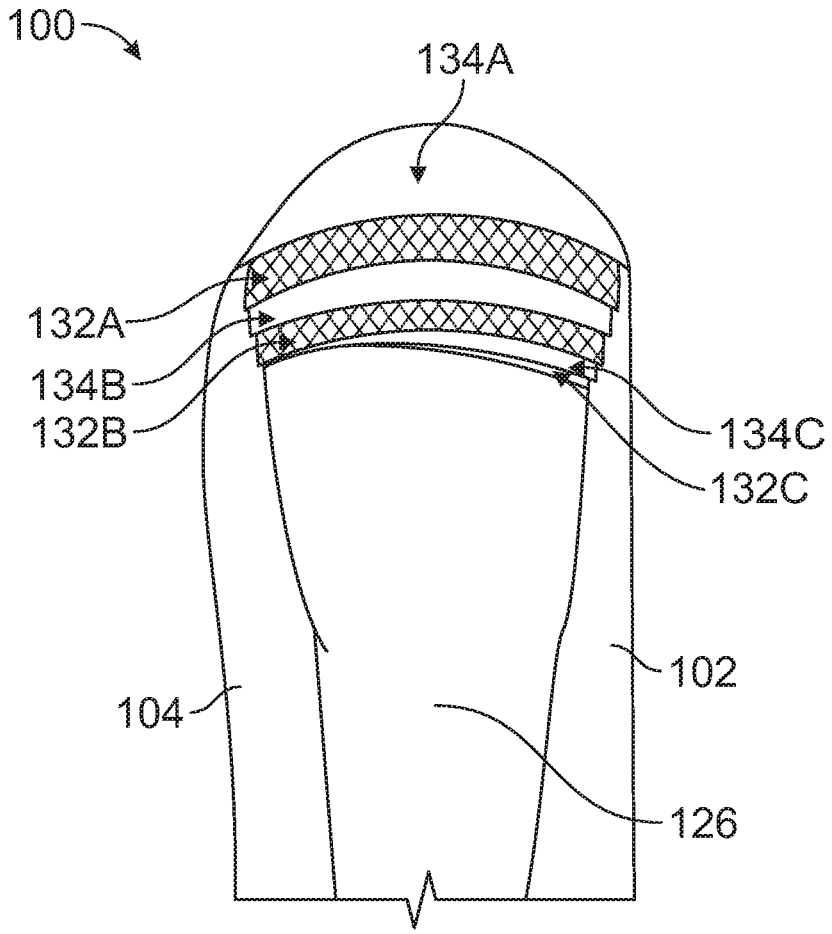
FIG. 8 illustrates a left side view of the garment of FIG. 6, according to an example embodiment.
Figure 9:
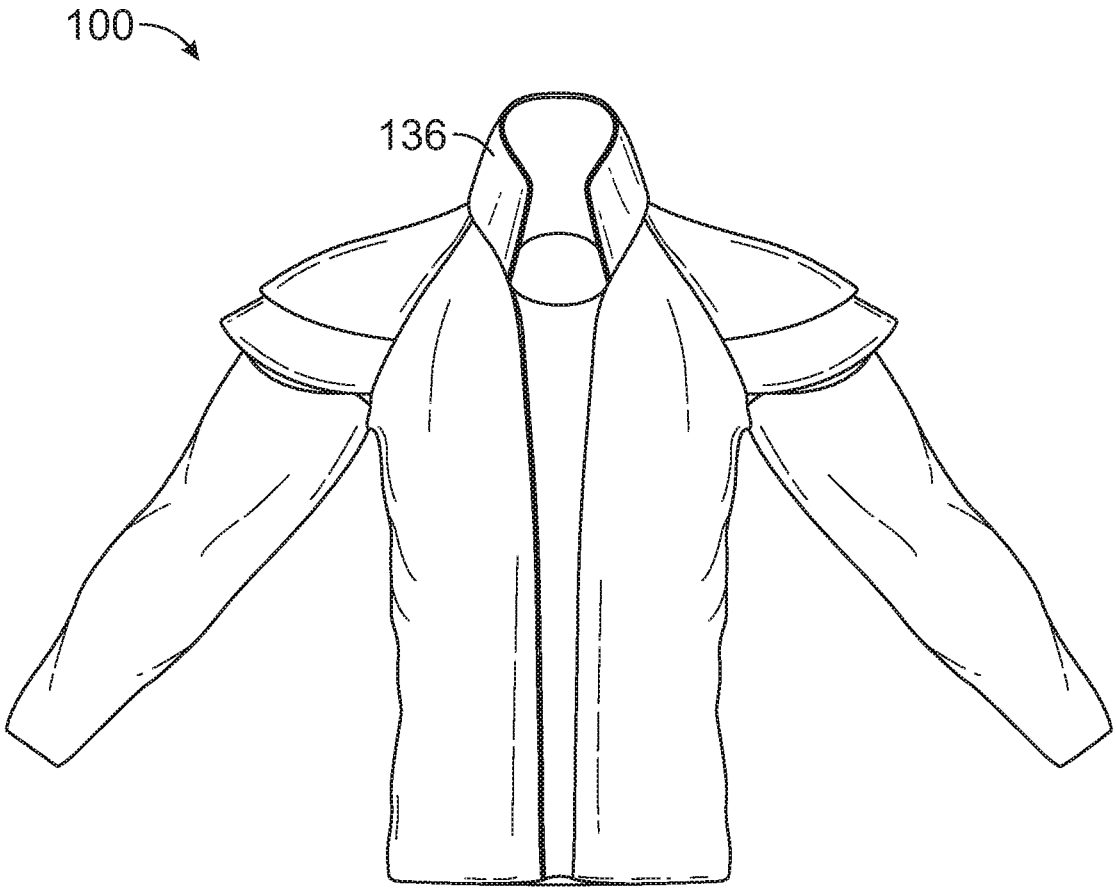
FIG. 9 illustrates a front view of another example garment, according to an example embodiment.
Figure 11:
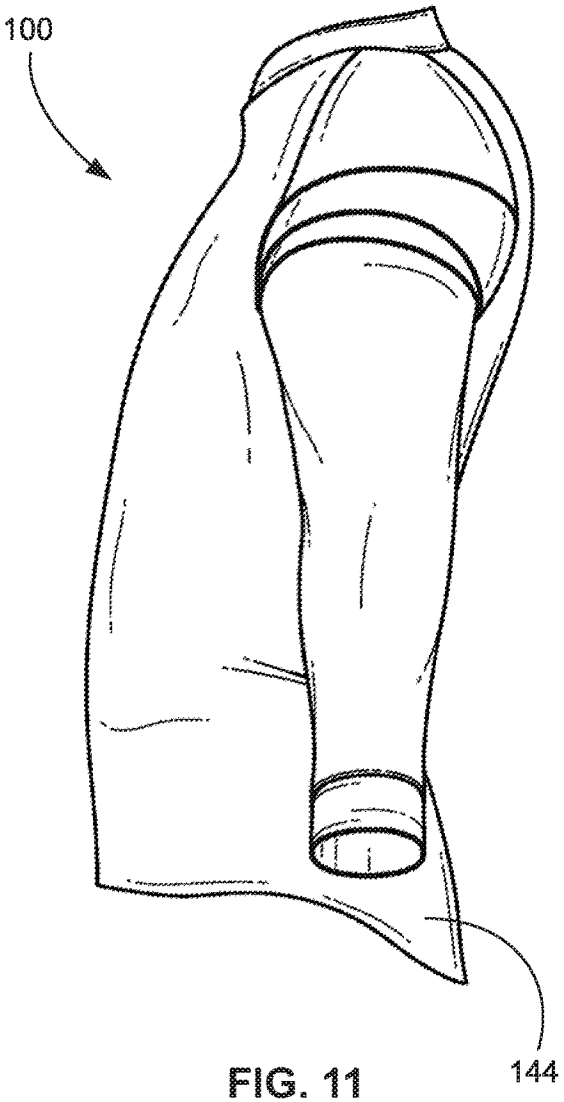
FIG. 11 illustrates a left side view of the garment of FIG. 9, according to an example embodiment.
Figure 10:
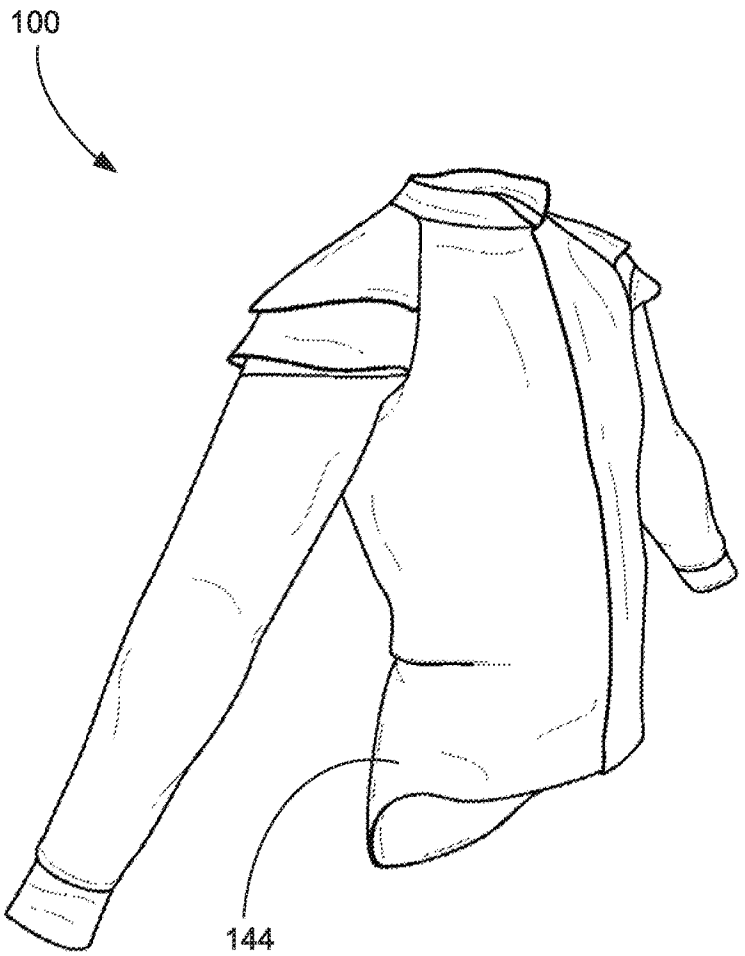
FIG. 10 illustrates a front perspective view of another example garment, according to an example embodiment.
Figure 12:
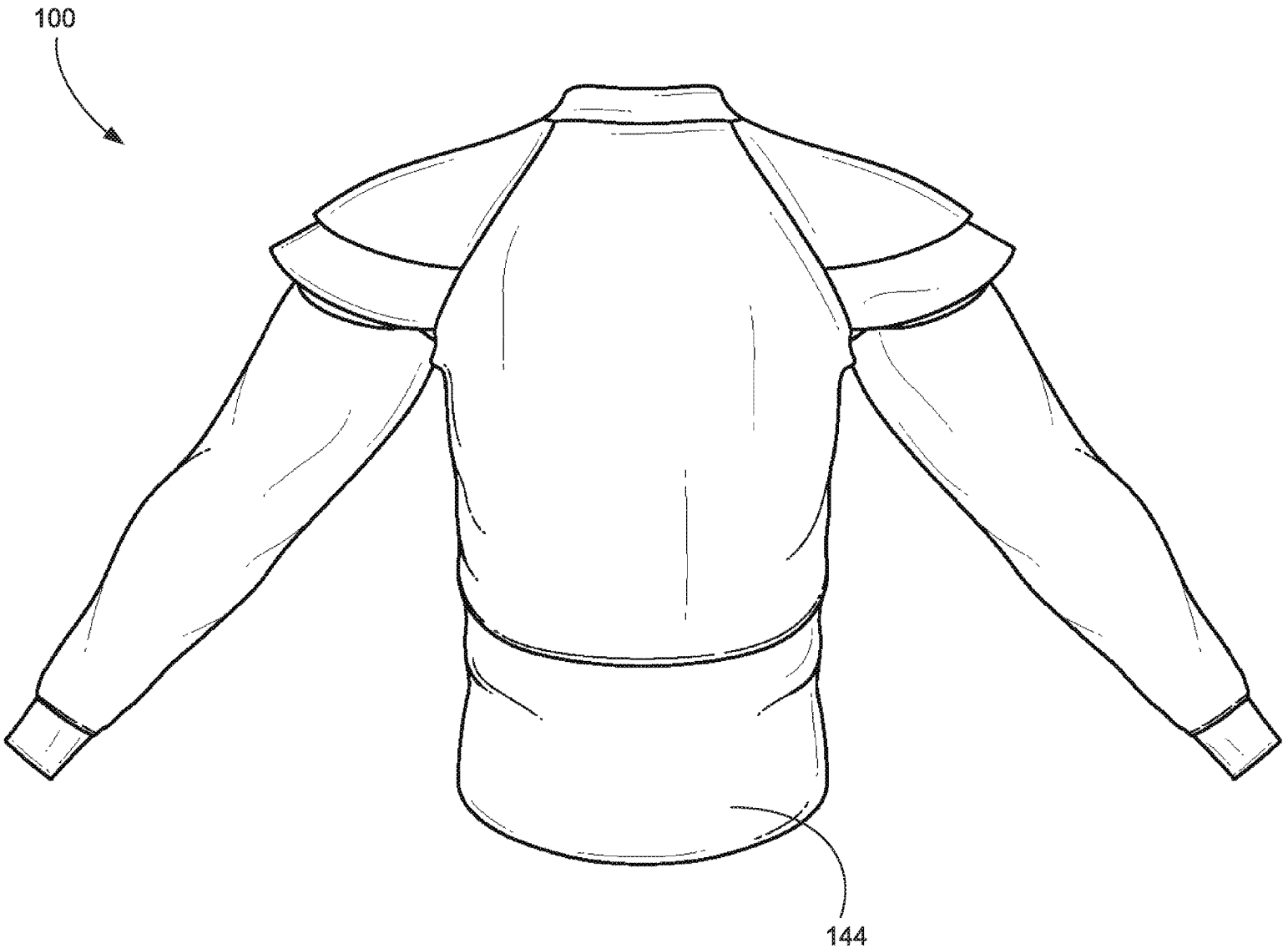
FIG. 12 illustrates a rear view of the garment of FIG. 9, according to an example embodiment.

In another example, as shown in FIGS. 7-8, the first plurality of elastic panels 122 further comprises a fifth elastic panel 122C covered by a fifth scallop-shaped panel 124C. A free end of the second scallop-shaped panel 124B at least partially overlaps the fifth scallop-shaped panel 124C. The second elastic panel 122B is positioned between the second scallop-shaped panel 124B and the fifth scallop-shaped panel 124C, and the fifth elastic panel 122C is positioned between the fifth scallop-shaped panel 124C and the second end 120 of the first sleeve 116. In such an embodiment, the second plurality of elastic panels 132 comprises a sixth elastic panel 132C covered by a sixth scallop-shaped panel 134C. A free end of the fourth scallop-shaped panel 134B at least partially overlaps the sixth scallop-shaped panel 134C. The fourth elastic panel 132B is positioned between the fourth scallop-shaped panel 134B and the sixth scallop-shaped panel 134C, and the sixth elastic panel 132C is positioned between the sixth scallop-shaped panel 134C and the second end 130 of the second sleeve 126.

The openable seam 106 may include a seam-fastener operable between an open condition of the openable seam and a closed condition of the openable seam. In one example, the seam-fastener comprises a zipper. The zipper may be oversized to easily enable a user to grab the zipper to remove the garment 100. The zipper may be a two-way zipper, such that the openable seam 106 may be opened from the top of the front panel 104 and/or the bottom of the front panel 104. In another embodiment, the seam-fastener comprises a plurality of loops positioned adjacent to a first edge of the openable seam 106 and a corresponding plurality of hooks positioned adjacent to a second edge of the openable seam 106. In one particular example, the openable seam 106 includes three sections including a plurality of loops adjacent to the first edge of the openable seam 106 and a corresponding three sections including a plurality of hooks adjacent the second edge of the openable seam 106. In another embodiment, the seam-fastener comprises a first plurality of magnets positioned adjacent to a first edge of the openable seam 106 and a corresponding second plurality of magnets positioned adjacent to a second edge of the openable seam 106. In one example, a first edge of the openable seam 106 overlaps a second edge of the openable seam 106 to thereby cover the seam-fastener. In yet another embodiment, the garment 100 includes both a zipper and a plurality of loops positioned adjacent to a first edge of the openable seam 106 and a corresponding plurality of hooks positioned adjacent to a second edge of the openable seam 106. Other embodiments are possible as well.

Figure 5:
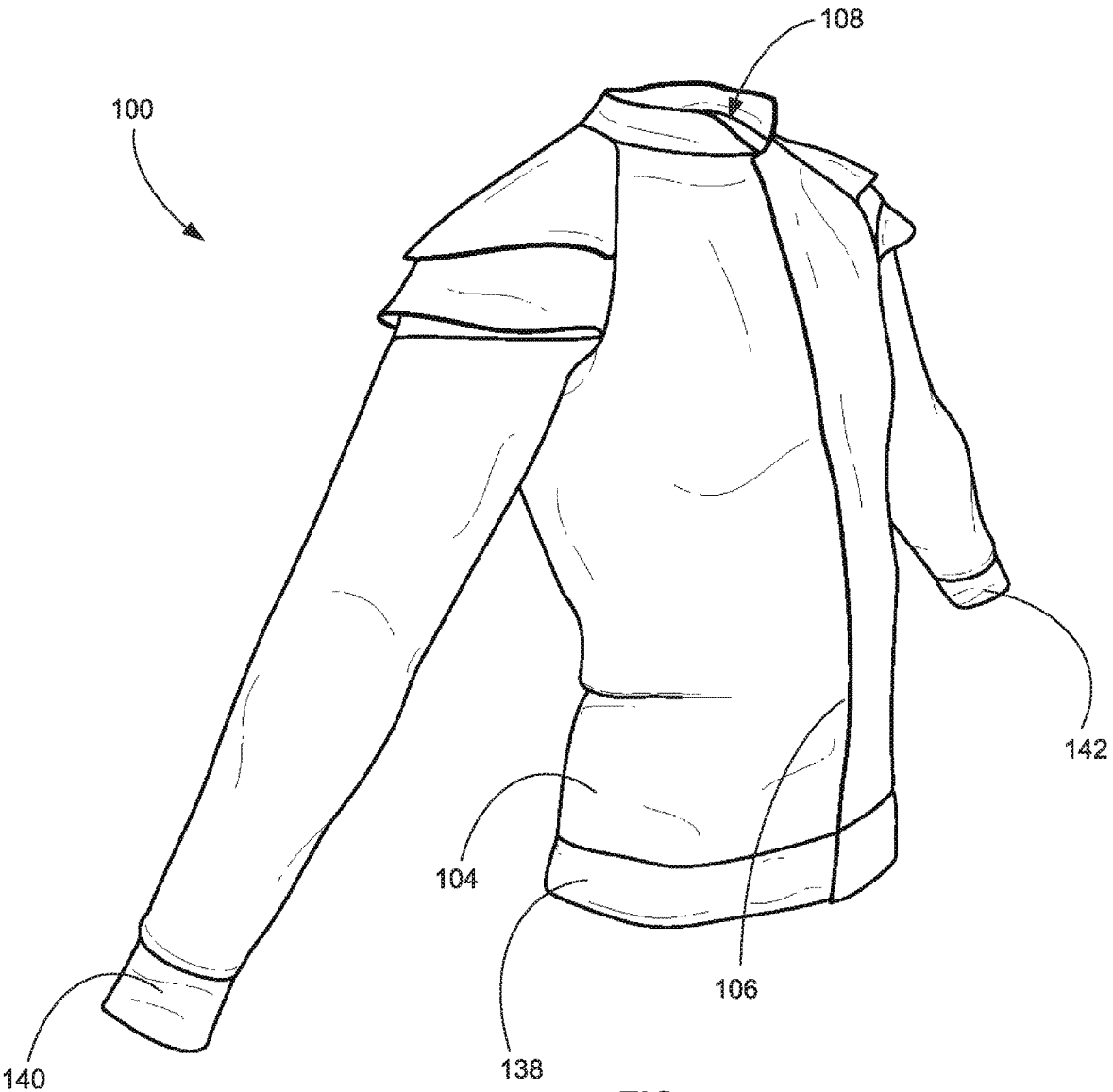
FIG. 5 illustrates a front perspective view of the garment of FIG. 1, according to an example embodiment.

In one embodiment, as shown in FIG. 5, the garment 100 may include a collar 136 coupled to the neck opening 108. In one example, the collar 136 is configured to extend upwards and cover a user's neck. The collar 136 may extend about 2.5 inches to about 5.5 inches in a vertical direction from the neck opening 108. In another example, the collar 136 is configured to cover the ears of a user. Here, the collar 136 may extend about 5.5 inches to about 10.5 inches from the neck opening 108. The collar 136 may have a high portion that wraps around the back of the head of a user extending from the right ear to the left ear and a tapered portion extending from each of the right ear and the left ear down towards to the user's jawline to thereby cover the ears of the user without obstructing the user's nose and mouth. In one example, the collar 136 comprises a material having sufficient stiffness to cause the collar 136 to remain in an upright position to thereby cover ears of a user. In a further example, stitching may be used to increase stiffness of the collar 136, as well as padding, piping and/or boning. In another example, the collar 136 includes a rigid or semi-rigid structure, like a plastic insert, surrounded by a fabric material to cause the collar 136 to remain in an upright position to thereby cover ears of a user.

In one embodiment, the garment 100 further includes a waist-band 138 coupled to the torso opening 114. The waist-band may comprise an elastic material configured to stretch based on the waist-size of the particular user. The elastic waist-band 138 may be configured to be tight around the waist of the user to thereby prevent cold air from entering the garment 100 and warm body heat from exiting the garment 100. Similarly, the garment 100 may also include a first wrist-band 140 coupled to the second end 120 of the first sleeve 116, and a second wrist-band 142 coupled to the second end 130 of the second sleeve 126. In one example, the first and second wrist-bands 140, 142 comprise an elastic material. As discussed above, the elastic nature of the first and second wrist-bands 140, 142 may be configured to be tight around the wrist of the user to thereby prevent cold air from entering the garment 100 and warm body heat from exiting the garment 100.

In another embodiment, the second end 120 of the first sleeve 116 and the second end 130 of the second sleeve 126 include an expandable opening. In various examples, the expandable opening comprises a hook and loop fastener, snaps or magnets. Such an embodiment may enable a user to more quickly remove the garment 100 to reenter the field of play, for example.

In another embodiment, as shown in FIGS. 7 and 8, the back panel 102 comprises a rear seat cover 144 configured to extend below the waist of a user to cover a rear of a user. The rear seat cover 144 may advantageously act as a barrier between a user's backside, for example, when the user is sitting on cold benches on the sidelines, thus maintaining the body temperature of the user. In one example, the rear seat cover 144 comprises additional padding material or insulating material that may beneficially increase comfort for the user in a seated position. In another example, the back panel 102 may further comprise one or more fasteners configured to removably hold the rear seat cover 144 such that the rear seat cover 144 does not cover a rear of a user. For example, the rear seat cover 144 may be folded up or rolled up. The fasteners may take the form of snaps, buttons, ties, magnets or hook and loop systems, as just some examples.

The exterior of the garment 100 may comprise a first material, and the interior of the garment 100 may comprise a second material that is different than the first material. In one example, the first material is waterproof. In particular, the first material may comprise a hard-faced waterproof material. The second material may comprise a fleece material, as an example. In another example, a dual-faced fabric that is hard-faced or waterproof on an exterior surface and fleece-lined on an interior surface, for example. Still further, padding or other insulating materials may be employed between the first material and the second material. Other combinations of fibers, yarns, and/or other materials are possible as well.

The garment 100 may further include a hood coupled to the neck opening 108. In one optional example, the hood is removably coupled to the neck opening 108 via a hook and loop system, a zipper, snaps or magnets. Other examples are possible as well.

The front panel 104 of the garment 100 may include two front exterior pockets 146A, 146B. The exterior pockets are "exterior" in that they are accessible from the exterior of the garment, but may only include an opening on the exterior surface of the front panel 104. In one embodiment, each pocket 146A, 146B is about 9 inches by inches square. The bottom 148A, 148B of each pocket 146A, 146B may be arranged about 3 to 5 inches above the bottom of the front panel 104 or the top of the waist band 138. Openings 150A, 150B are provided for each pocket 146A, 146B that are about 6 inches long and centered between the top and bottom of each pocket 146A, 146B. The openings 150A, 150B may be reinforced with interfacing. The effect of the arrangement of the pockets 146A, 146B is to elevate a user's arms to increase a resting state of the muscles in the user's forearm and upper arm. In addition, such an arrangement of the pockets 146A, 146B may also benefit in muscle recovery since the user's arms are at rest and not in a hanging position. In another embodiment, the back panel 102 includes a rear exterior pocket 152 having a first opening 154A and a second opening 154B arranged along side seams 115A, 115B where the front panel 104 is coupled to the back panel 102. The first opening 154A and the second opening 154B of the rear exterior pocket 152 may be connected such that there is a single pouch (i.e., a "kangaroo" pocket). The rear exterior pocket 152 may be used to maintain warmth in a user's hands, for example a quarterback. In another embodiment, the back panel 102 may include two separate exterior pockets that do not connect.

In another embodiment, the front panel 104 may include an interior pocket including a slit providing access from the interior pocket to an interior of the garment 100. The interior pocket is "interior" in that the only access to the pocket is from the interior surface of the garment. In one example, the interior pocket in the front panel 104 may be positioned adjacent to a hip of a user. Similarly, the back panel 102 may include an interior pocket including a slit providing access from the interior pocket to an interior of the garment. In one example, the interior pocket in the back panel 102 may be positioned just below the neck opening 108. These interior pockets may be used to house a portable music player, and the slits may be used to pass headphones through to the interior pockets to the interior of the garment 100.

Figure 6:
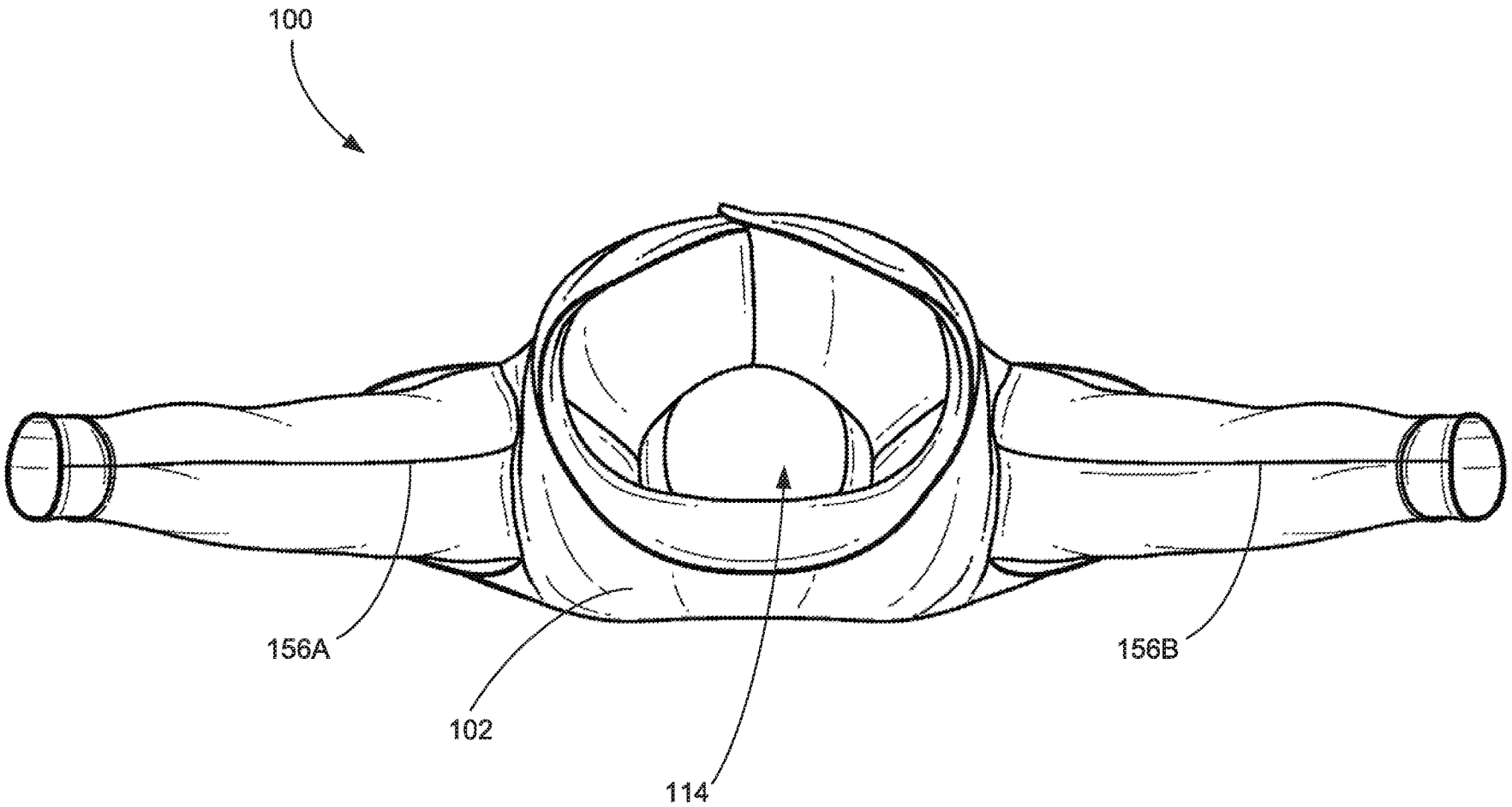
FIG. 6 illustrates a bottom view of the garment of FIG. 1, according to an example embodiment.

In another embodiment, as shown in FIG. 6, an underside of the first sleeve 116, an underside of the second sleeve 126 and/or the side seams where the front panel 104 and back panel 102 are coupled together include ventilation seams 156A, 156B that may be opened and closed by a user. For example, such ventilation seams 156A, 156B may be opened via a zipper, hook and loop system, magnets, or other means. These ventilation seams 156A, 156B may release heat from garment 100 in the event that a user is too warm.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

Since many modifications, variations, and changes in detail can be made to the described example, it is intended that all matters in the preceding description and shown in the accompanying figures be interpreted as illustrative and not in a limiting sense. Further, it is intended to be understood that the following clauses (and any combination of the clauses) further describe aspects of the present description.

What is claimed is:

1. A garment, comprising:

a back panel;

a front panel including an openable seam, wherein the back panel and the front panel are coupled together and define a neck opening, a first arm opening, a second arm opening and a torso opening;

a first sleeve having a first end and a second end, the first end of the first sleeve coupled to the first arm opening, the first end of the first sleeve having a first plurality of elastic panels; and a second sleeve having a first end and a second end, the first end of the second sleeve coupled to the second arm opening, the first end of the second sleeve having a second plurality of elastic panels;

wherein the first plurality of elastic panels comprises a first elastic panel covered by a first scallop-shaped panel and a second elastic panel covered by a second scallop-shaped panel, wherein a free end of the first scallop-shaped panel at least partially overlaps the second scallop-shaped panel, wherein the first elastic panel is positioned between the first scallop-shaped panel and the second scallop-shaped panel, wherein the second elastic panel is positioned between the second scallop-shaped panel and the second end of the first sleeve; and wherein the second plurality of elastic panels comprises a third elastic panel covered by a third scallop-shaped panel and a fourth elastic panel covered by a fourth scallop-shaped panel, wherein a free end of the third scallop-shaped panel at least partially overlaps the fourth scallop-shaped panel, wherein the third elastic panel is positioned between the third scallop-shaped panel and the fourth scallop-shaped panel, wherein the fourth elastic panel is positioned between the fourth scallop-shaped panel and the second end of the second sleeve.

2. The garment of claim 1, further comprising a collar coupled to the neck opening.

3. The garment of claim 2, wherein the collar extends about 2.5 inches to about 5.5 inches in a vertical direction from the neck opening.

4. The garment of claim 2, wherein the collar is configured to cover ears of a user, and wherein the collar extends about 5.5 inches to about 10.5 inches in a vertical direction from the neck opening.

5. The garment of claim 4, wherein the collar comprises a material having sufficient stiffness to cause the collar to remain in an upright position to thereby cover the ears of the user.

6. The garment of claim 4, wherein the collar includes a rigid structure surrounded by a material to cause the collar to remain in an upright position to thereby cover the ears of the user.

7. The garment of claim 4, wherein the collar includes a high portion configured to wrap around a back of a head of the user to extend from a right ear to a left ear and a tapered portion configured to extend from each of the right ear and the left ear down towards a jawline of the user to thereby cover the ears of the user without obstructing a nose and a mouth of the user.

8. The garment of claim 1, further comprising a waist-band coupled to the torso opening, wherein the waist-band comprises an elastic material.

9. The garment of claim 1, wherein the back panel comprises a rear seat cover configured to cover a rear of a user.

10. The garment of claim 9, wherein the rear seat cover comprises padding material.

11. The garment of claim 1, further comprising:

a first wrist-band coupled to the second end of the first sleeve; and a second wrist-band coupled to the second end of the second sleeve, wherein the first and second wrist-bands comprise an elastic material.

12. The garment of claim 1, wherein the second end of the first sleeve and the second end of the second sleeve include an expandable opening.

13. The garment of claim 1, wherein an exterior of the garment comprises a first material, and wherein the interior of the garment comprises a second material that is different than the first material.

14. The garment of claim 13, wherein the first material is waterproof.

15. The garment of claim 1, wherein the first and second plurality of elastic panels comprises a breathable mesh material.

16. The garment of claim 1, wherein the front panel includes at least two front exterior pockets.

17. The garment of claim 1, wherein the back panel includes a rear exterior pocket having a first opening and a second opening, wherein the first opening and the second opening are connected such that there is a single pouch.

18. The garment of claim 1, further comprising:

a first ventilation seam arranged along an underside of the first sleeve and along a first seam coupling the front panel to the back panel, and a second ventilation seam arranged along an underside of the second sleeve and along a second seam coupling the front panel to the back panel.

19. The garment of claim 1, wherein the first plurality of elastic panels further comprises a fifth elastic panel covered by a fifth scallop-shaped panel, wherein a free end of the second scallop-shaped panel at least partially overlaps the fifth scallop-shaped panel, wherein the second elastic panel is positioned between the second scallop-shaped panel and the fifth scallop-shaped panel, wherein the fifth elastic panel is positioned between the fifth scallop-shaped panel and the second end of the first sleeve; and wherein the second plurality of elastic panels comprises a sixth elastic panel covered by a sixth scallop-shaped panel, wherein a free end of the fourth scallop-shaped panel at least partially overlaps the sixth scallop-shaped panel, wherein the fourth elastic panel is positioned between the fourth scallop-shaped panel and the sixth scallop-shaped panel, wherein the sixth elastic panel is positioned between the sixth scallop-shaped panel and the second end of the second sleeve.

* * * * *